United States Patent [19]

Rooyakkers et al.

[11] Patent Number: 4,959,945

[45] Date of Patent: Oct. 2, 1990

[54] FOLDER

[75] Inventors: Michael L. Rooyakkers, Kimberly; Ken E. Harvey, Green Bay, both of Wis.

[73] Assignee: Valley Tissue Packaging, Inc., Green Bay, Wis.

[21] Appl. No.: 394,015

[22] Filed: Aug. 15, 1989

[51] Int. Cl.[5] ..... B65B 7/02

[52] U.S. Cl. ..... 53/378

[58] Field of Search ..... 53/230, 231, 374, 378, 53/380, 381 R, 379

[56] References Cited

U.S. PATENT DOCUMENTS

| | | | |
|---|---|---|---|
| 2,584,529 | 2/1952 | Allen | 53/378 |
| 2,634,564 | 4/1953 | Bergstein | 53/378 |
| 2,909,875 | 10/1959 | Imbs | 53/378 |
| 3,110,144 | 11/1963 | Johansen et al. | 53/378 |
| 3,213,591 | 10/1965 | Feurstein et al. | 53/379 X |
| 3,869,846 | 3/1975 | Timmerbeil | 53/378 X |
| 4,098,057 | 7/1978 | Holcomb | 53/230 |
| 4,215,522 | 8/1980 | Clift et al. | 53/374 X |
| 4,348,853 | 9/1982 | Morse et al. | 53/374 X |

*Primary Examiner*—Robert L. Spruill
*Assistant Examiner*—Linda B. Johnson
*Attorney, Agent, or Firm*—Foley & Lardner

[57] ABSTRACT

A folder for use in a variety of applications, being especially well suited for folding a sheet of overwrap around a stack of paper pulp sheets, includes three stationary folder sections and an extensible folding plate which performs the back tucking function. The plate is arranged to fold the back edge inwardly as the bale is moved along a conveyor line. After the rear edge has been folded inwardly, the bale slides past three stationary folder devices which in turn fold the front, bottom and top flaps of the overwrap. The folded package is then secured by conventional strapping techniques.

17 Claims, 6 Drawing Sheets

FOLDER

BACKGROUND OF THE INVENTION 1. Field of the Invention

In its broadest form, the present invention relates to folding equipment useful for folding inwardly the ends of a sleeve of overwrap material which surrounds a block or stack of material having a generally square or rectangular cross-section. In the preferred embodiment, the invention comprises a folder having a single, moveable element and three substantially stationary elements adapted to fold the end flaps of a sleeve of paper stock about a stack of pulp sheets. 2. Description of the Prior Art For many years, and for many different applications, it has been necessary to wrap a box, block or stack of material to surround the top, bottom, sides and ends thereof with a suitable wrapping material. For example, in wrapping a sheet of paper about a stack of paper pulp, such as occurs prior to export of pulp, the package is inserted into an overwrap material in such a manner that a C-fold is formed. The ends are typically wrapped by folding the back, top and bottom portions thereof using pneumatic devices which extend toward a pulp bale and move in a defined path to press the overlying portions of wrap material against the block or stack. The stack, having a fold completed on two sides and an overwrap on three, is rotated so that the remaining open end having top, bottom, front and back flaps extends toward yet another pneumatic machine having many moving parts. The latter machine individually folds the four flaps around the remaining end using an engaging and pressing motion, after which the stack is moved to a strapping machine to secure the wrapping in place.

Such wrapping may be necessary thousands of times per day, and equipment which includes many moving parts is undesirable in such applications. Discussing the pulp process in somewhat greater detail, the pulp is typically prepared in sheet form and cut into equally sized rectangular sheets and stacked to a desired height. To increase the density to volume ratio, the stack is typically pressed and overwrapped by the process described above. The most complex, time consuming and expensive part of the process of preparing the pulp for shipment, after its preparation in the mill, is the folding of the ends of the paper sleeve, a process which is currently being performed by very complex and expensive machinery. Not only is the present equipment expensive, it is subject to mechanical failure resulting in numerous periods of plant down time. A folder which contains fewer moving parts and which would increase the speed of the packaging operation would represent a substantial advance in this art.

SUMMARY OF THE INVENTION

In its preferred form, the present invention provides an improved folding device for folding inwardly, the rear, forward, bottom and top flaps of a sleeve of overwrap material, using fewer moving parts to do so.

The present invention provides an improved folder which allows increased speed in the folding operation.

The present invention provides an improved folder having a high degree of reliability and ease of maintenance.

In its illustrated form, the present invention also provides an improved folder concept which may readily be adapted to a variety of folding needs.

The present invention also provides an improved folder which uses moving parts only for folding one of the flaps of a sleeve of overwrap material.

The present invention, to provide the advantages set forth above, generally includes a separation conveyor for moving bales of material to be overwrapped, a positioning plate on a flight conveyor to carry an article to be folded through the folding section. A back end folding assembly capable of reciprocation and rotating about an axis is provided for urging the back end of the overwrap sleeve against the end of the item being packaged. The bale then moves along and against stationary plates arranged in such a way that the front, bottom and top flaps are folded neatly and quickly into position. Following the folding of the four flaps, the package is strapped, taped or otherwise secured by conventional equipment. Futher details concerning the form of the present invention will become apparent to those skilled in the art after the following description has been read. The illustrated details and their equivalents are deemed to fall within the scope of the invention if they fall within the scope of the appended claims.

DESCRIPTION OF THE DRAWINGS

In the FIGURES, like reference numerals illustrate like components.

DESCRIPTION OF THE PREFERRED EMBODIMENT

Before proceeding to the drawings, it should be reemphasized that the description of the present invention for use as a pulp bale overwrap folder is for purposes of illustration and not limitation. As indicated previously, there are a number of similar packaging applications in which it is necessary to fold and seal a sleeve of overwrap material, the ends of the sleeve extending beyond the ends of the article being packaged. The device disclosed herein is useful in such applications, it being necessary to vary only the size and location of the various components for a particular application. Such variations could easily be accomplished by those skilled in the art after reading the specification.

The present invention will now be described in the environment of pulp folding equipment. Pulp is generally cut into sheets at a paper mill, the sheets being stacked until each stack reaches a predetermined weight. Stacks are then conveyed to a press station where they are squeezed to a desired height. Subsequently, the stacks are moved to an overwrap section where each stack or bale is overwrapped by inserting it into a large sheet of pulp or Kraft paper (for example). At this point, a C-fold is formed resulting in the covering of the top, bottom and one side of the stack. Pneumatic mechanisms having many moving parts, and being well known, use plates to press inwardly on the overlying wrapping material on three flaps of two additional sides to fold the top and bottom flaps thereof, as well as one vertical flap resulting from the C-fold). Such prior art equipment operates sequentially, leaving a bale of pulp which is wrapped and/or folded on five of its six sides. The present invention is primarily adapted for closure of the overwrap material which extends from the sixth side, or end, as will now be described in detail. However, the stationary plate folder portion of the invention can also be used to perform the side flap folding of the aforementioned process.

Figure 1:
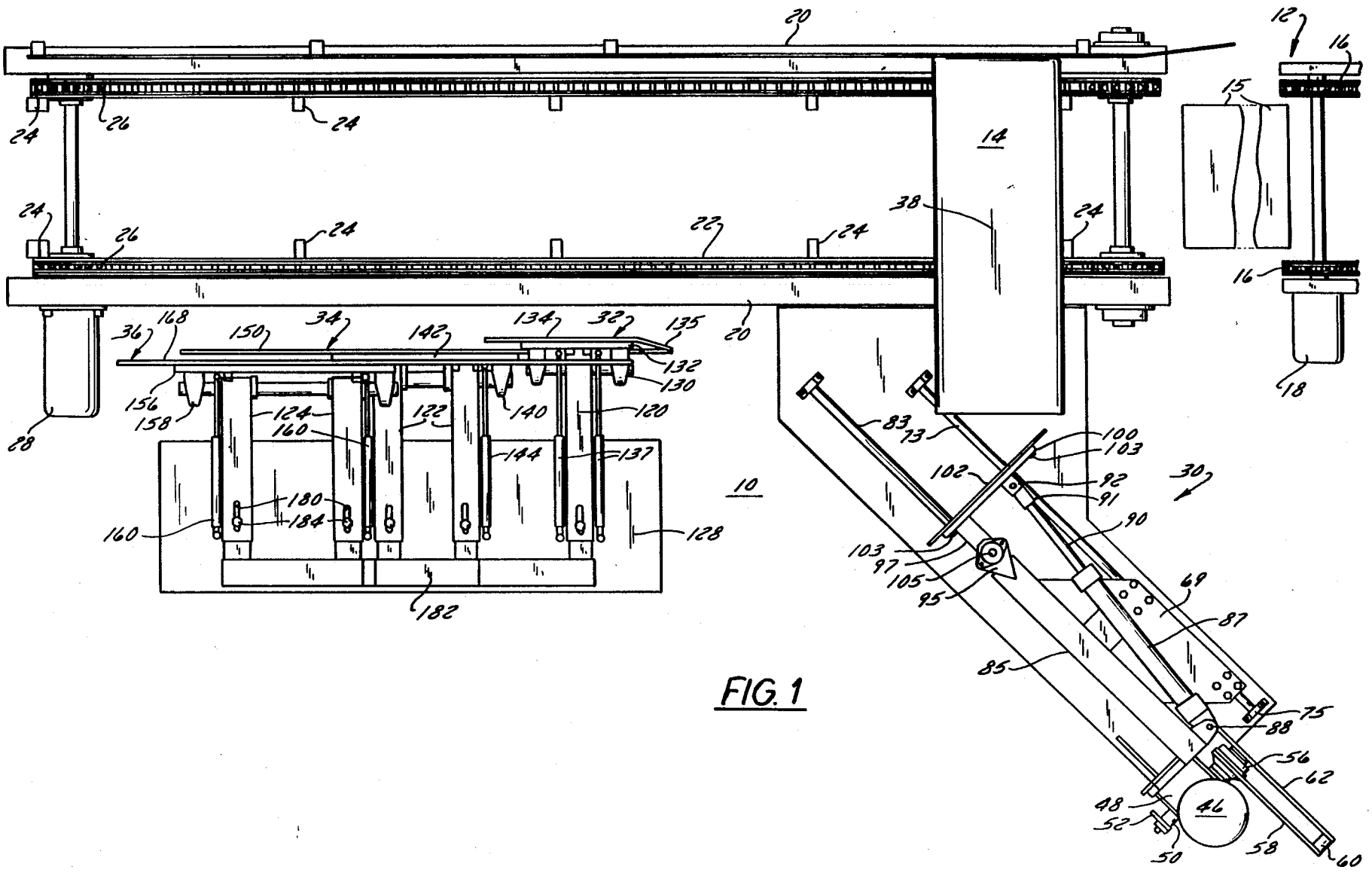
FIG. 1 is a top plan view of a folder according to a preferred form of the present invention.

FIG. 1 shows in rather schematic fashion the overall layout of the folder of the present invention. Folder 10 includes three major sections, two of which are known to the art, i.e. a separation conveyor 12 used to bring single bales of overwrap pulp 14 to the folder and a positioning plate 15, which is also known, to rotate the bales 14 so that their open ends are aligned perpendicularly to the axis of the conveyor. The drive sprocket 16 and conveyor drive motor 18 are shown in general form, as are the frame elements 20 for folder 10.

The positioning plate 15 is also conventional and the details are not shown. It functions by raising slightly and rotating 90° to properly position the bale 14 for being folded by the folder 10 of the present invention.

The bale is then passed onto a folding conveyor 22, e.g. by a flight bar 24 or any other conventional device. It then moves from plate 15 onto the conveyor 22. Sprockets 26 and the drive motor 28 therefor are shown in general form in FIG. 1.

Figure 2:
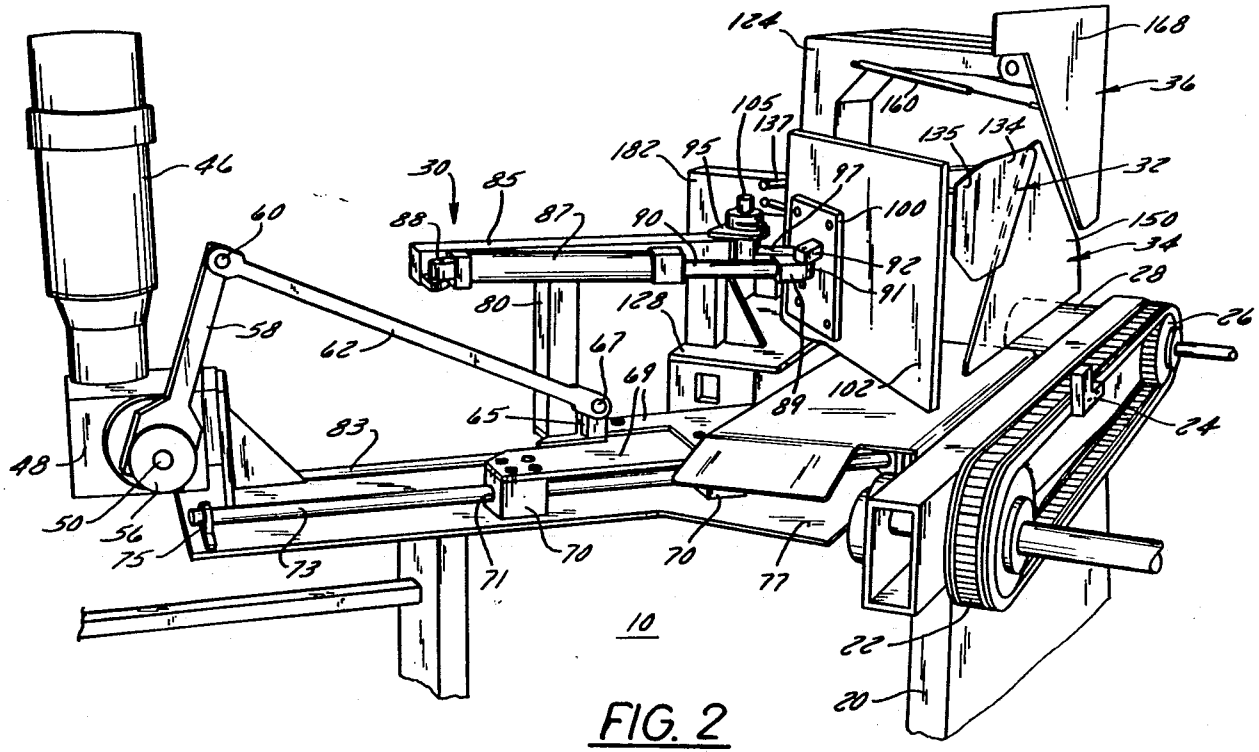
FIG. 2 is a perspective view of the major components of the folder according to the preferred embodiment shown in FIG. 1.

The four tuck assemblies of the present invention are also shown in FIGS. 1 and 2. They include, from upstream end to downstream end, the back tuck folder assembly 30, the front flap folder asssembly 32, the bottom flap folder assembly 34 and the top flap folder assembly 36. A very brief explanation of the folder assemblies at this point in the description will assist in understanding the details of the device to be provided below. The first step is activation of back tuck folder assembly 30 which includes a generally vertical reciprocating plate (to be described below). It will suffice here to say that upon full forward movement of assembly 30 and rotation of its plate, the rear or back flap of the overwrap material 38 is tucked onto the end of the bale 14. Folder assemblies 32, 34 and 36 are generally stationary plates shaped so that movement of the bale 14 along the conveyor path will result in sequential tucking of the front, bottom and top flaps which remain after the back tuck. A detailed description of the latter three folders will also be provided.

Located downstream of folder 10 is another piece of equipment (not shown) which will strap the bale to secure the tucked end flaps. Since this piece of equipment is well known, it will not be shown in the specification. Strapping or tape can be quickly applied to the bale to ready it for downstream conveyor transportation to a storage or shipment area.

FIG. 2 is a perspective view of the back tuck assembly 30, illustrating generally how its face plate reciprocates between a first retracted position to a second extended position. As will be seen later, pivotal movement relative to the axis of the conveyor is also accomplished during such movement.

Such reciprocating movement is caused by a motor 46 coupled to a gear reducer 48 from which extends a drive shaft 50. One end of shaft 50 includes a limit switch cam 52 used to control the extension. The other end of shaft 50 is coupled to a torque limiter 56 which drives a first connecting rod 58. Rod 58, at its outer end, is rotatably coupled to a cam arm 60 which also receives the outer end of a second connecting arm 62.

Referring simultaneously to FIG. 1 and FIG. 2, it can be noticed that arm 62 is rotatably coupled to a bracket 65 by coupling clevis 67, bracket 65 in turn being coupled to a sliding, generally horizontal plate 69. Plate 69 is adapted for reciprocal movement toward and away from conveyor 22. Plate 69 includes forward and rear slide blocks 70 (only the rear one of which is shown in FIG. 2) each of which has a hole 71 therethrough. Extending through holes 71 is a cylindrical rod 73 having a backstop mount 75 at the rearward end of a stationary platform 77 which is generally planar and lies in a plane parallel to and slightly below the surface of conveyor 22.

Near bracket 65 and extending vertically and upwardly from plate 69 is a support column 80. Beneath column 80 is another rod 83 which is parallel to and spaced apart from rod 73. Block members are provided beneath plate 69 in the vicinity of column 80 to provide more stationary and controlled travel of plate 69 as it extends from the rearward position shown best in FIG. 1 to the extended portion shown in FIG. 2.

Column 80, at its upper end, supports a beam 85 which is aligned in such a manner that it is generally parallel to and spaced above rod 83. At the end of beam 85, nearest motor 46, the first end 88 of a cylinder 87 is pivotally coupled. Cylinder 87 includes a piston rod 90 extending from its second, end 89, the free end 91 of the piston rod 90 being pivotally coupled to a bracket member 92, which will soon be described in greater detail.

At the outer end of beam 85, a bearing device 95 having a vertical axis is secured. The bearing 95 is coupled to an extension 97 which extends outwardly from beam 85 and toward conveyor 22. A flat, generally vertical plate 100 is coupled to brackets 92 and to the outer end of extension 97. A back tuck plate means 102 is secured to plate 100 by any conventional fastening technique, such as bolts 103, and may be transparent (e.g. made from a clear plastic material such as Lexan TM plastic), or plate 102 may be made from other wood, glass, metallic or plastic materials.

Figure 8:
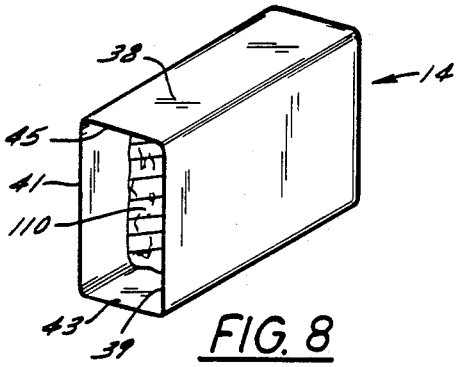
FIG. 8 is a perspective view of a bale of pulp showing a sleeve overwrap extending from one end.
Figure 9:
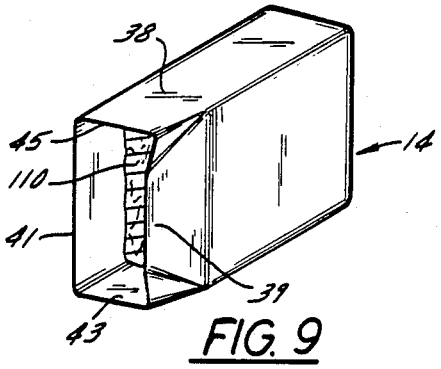
FIG. 9 is a perspective view of the bale of FIG. 8 with a portion of the rear flap folded inwardly.
Figure 10:
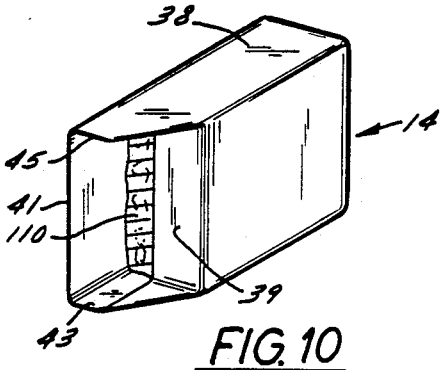
FIG. 10 is a perspective view of the bale of FIG. 8 showing the rear fold completed.

It will now be appreciated that plate 69, with its supported column 80, cylinder 87 and tuck plate 102 are reciprocated by activation of motor 46, such reciprocation moving plate 102 toward and away from conveyor 22. It can also be appreciated by reference to FIGS. 4 and 5 that plate 102 can be pivoted about the axis 105 of bearing 95 by extension of piston rod 90. Retraction of piston rod 90 into cylinder 87 will cause rotation of plate 102 to the position shown in FIG. 5. It can further be appreciated by reference to FIGS. 3, 4 and 5 that the rear flap 39 of the bale 14 is folded as the bale moves along conveyor 22 by extension of the plate 69 and its supported components. To avoid crushing of the rear flap 39, piston rod 90 is extended during such forward movement as is shown in FIG. 4. When a partial back tuck has been accomplished, retraction of cylinder 90 is carried out to shift plate 102 to the position shown in FIG. 5 and to finish the rear tuck. Retraction of the entire plate using motor 46 is then carried out so that the apparatus is prepared for its next cycle. Reference should now be made to FIGS. 8–10 to shown how a stack of pulp sheets 110 having four open flaps in overwrap 38 leaves the above-described portion of the machine with the back flap 39 folded as illustrated in FIG. 10.

Figure 6:
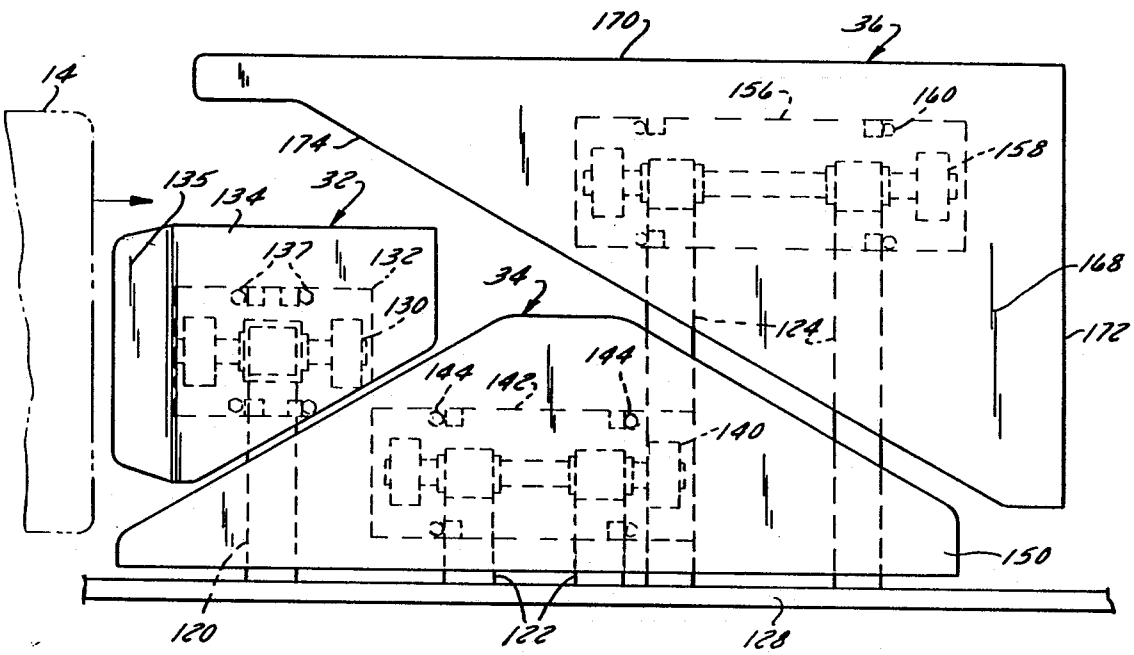
FIG. 6 is a front elevation view of the front, bottom and top flap folder assemblies according to the preferred form of the present invention.
Figure 7:
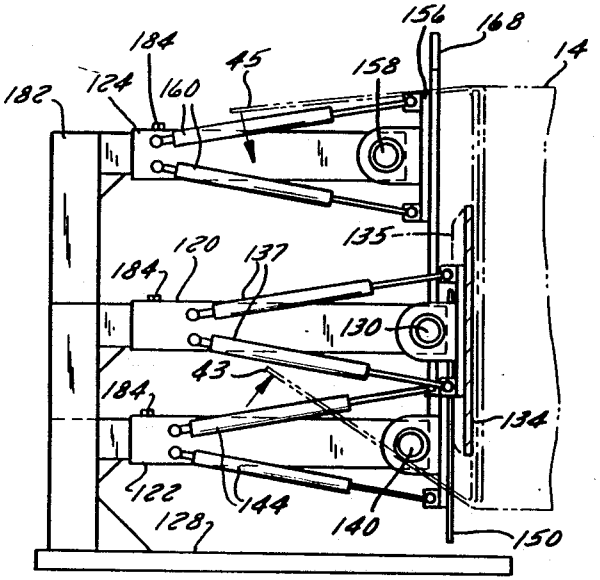
FIG. 7 is a side elevational view of the front, bottom and top folder assemblies according to the preferred embodiment of the present invention.

Those FIGURES which show the assemblies for tucking the remaining flaps of overwrap 18 are FIGS. 6 and 7. While FIG. 6 shows each of the three tuck assemblies 32, 34 and 36 to be non-transparent (the supports therefore being shown in dotted line configuration), transparent plastic materials may also be used. Before proceeding to a detailed description of each of the components, it should generally be noted that these components, unlike the back tuck assembly, remain relatively stationary. However, as will be seen from the description of the drawings, each assembly is allowed some limited degree of movement to accomodate for the movement of the bale end and to compensate for minor misalignments of the bales and minor variations in the sizes thereof.

Tuck assemblies 32, 34 and 36 are supported by pillar support member 120, 122 and 124 respectively, each of such pillar supports being rigidly attached to the frame 128 of folder 10. Pillar 120 (see FIG. 6) extends from a frame element 128 in an upward direction to support a bearing member 130 having an axis parallel to the conveyor and spaced above the plane thereof. A plate 132, (of generally rectangular configuration) is secured to bearing member 132 in such a way that it can rotate generally about the axis of bearing member 130. Secured to plate 132, in turn, is the front tuck plate 134 having its leading or upstream edge 135 bent back therefrom generally in the direction of the back tuck assembly 30. Plate 134 is of sufficient size that it can neatly tuck the forward flap 41 and, accordingly, will have a height less than the height of bale 14. Four air shock absorbers 137 are mounted on pillar 120 and to plate 132 to provide a limited degree of rotational movement about the axis of bearing member 130.

Figure 3:
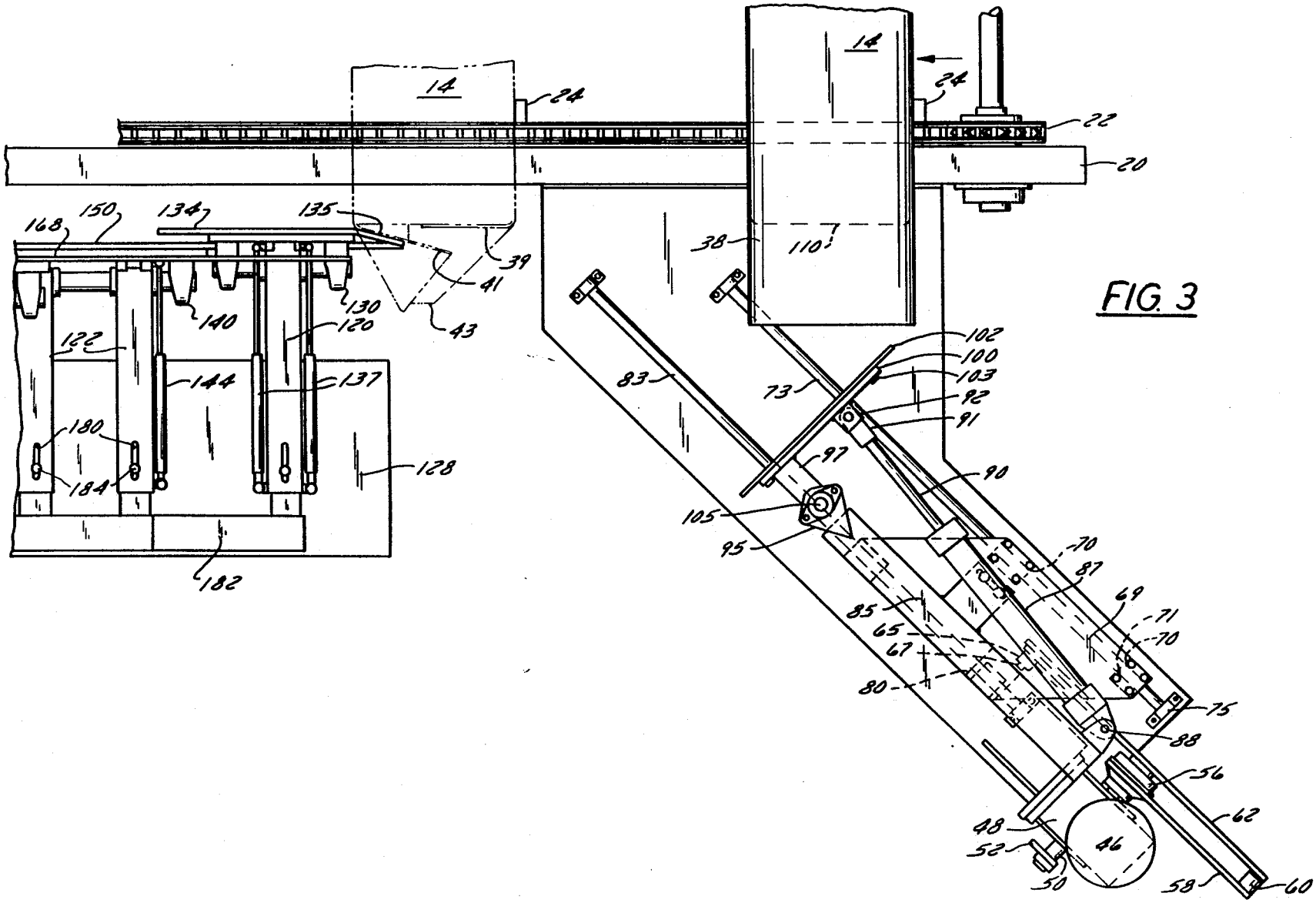
FIG. 3 is a top plan view, showing a portion of the folder according to the preferred embodiment of the present invention.
Figures 4, 5:
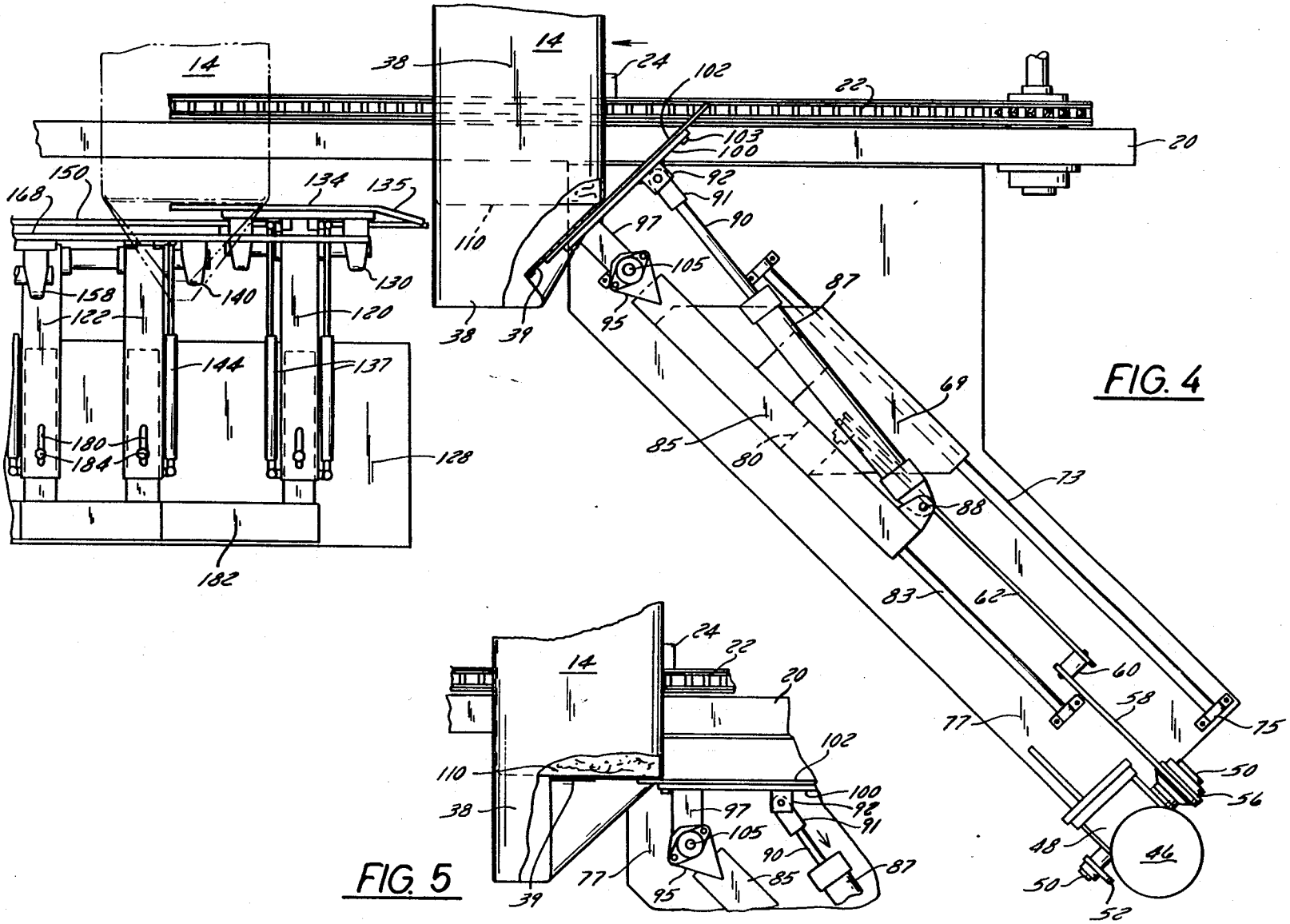
FIG. 4 is a top plan view of the folder according to the present invention, showing the back tuck assembly in the extended position.
FIG. 5 is a detailed top plan view, showing rotation of the plate of the back tuck assembly to complete the back tuck fold.
Figure 11:
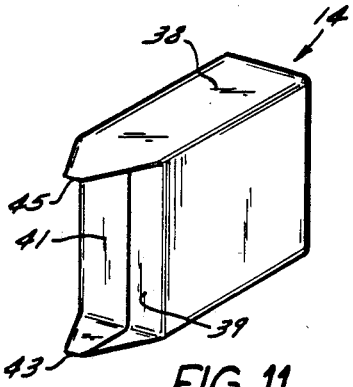
FIG. 11 is a perspective view of the bale of FIG. 8 with the rear fold and front fold completed.

The operation of the front folder plate is shown in FIG. 3 where edge 135 of plate 134 contacts the front flap 41 of the bale and presses it toward the still exposed end of the pulp stack 110. Folding is completed by the planar sheet 134 as movement of the bale down the conveyor continues. Completion of the front fold is shown in FIG. 11.

Figure 12:
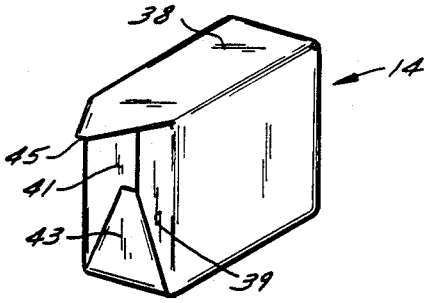
FIG. 12 is a perspective view of the bale of FIG. 8 with the bottom flap also folded.

A pair of pillars 122 support the bottom flap folder assembly 34 which is similar to the front tuck assembly 32, except for the arrangement and size of the plate shortly to be described. Pillars 122 support a bearing element 140, which in turn supports a plate 142. Air shocks 144 are mounted between pillars 122 and plate 142 in the manner previously described. The bottom flap assembly includes a generally triangular plate 150 attached to plate 142 and having a bottom edge generally parallel to and spaced only slightly above conveyor 22. The upper portion of the triangular plate 150 is truncated and terminates just downstream of the downstream end of the front folder plate 134. Plate 150 engages bale 14 at approximately the same time as edge 135 of front tuck assembly 32 does, whereby the bottom flap 43 is folded upwardly at the time that the foward flap 41 is completed (as shown in FIG. 12), i.e. shortly after the bale passes downstream of front flap assembly 32.

Figure 13:
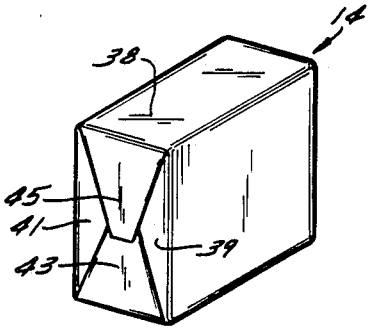
FIG. 13 is a perspective view of a completly packaged bale, folded using the apparatus of the preferred embodiment of the present invention.

It will be appreciated then that only the top flap 45 remains to be folded,, and such is accomplished by top folder assembly 36 supported on pillars 124. A plate 156 is mounted to a bearing member 158 and air shocks 160 are coupled between pillars 124 and plate 156 in the manner previously described. A folder plate 168 is attached to plate 156, plate 168 having a generally triangular shape including an upper generally horizontal edge 170, a vertical edge 172 at its downstream end and a hypotenuse edge 174 extending from generally above the front tuck assembly 32 downwardly to just beyond the downstream end of bottom tuck assembly 34. In this manner, it can be appreciated that as bale 14 moves downstream in folder 10, the top flap will be the last to be folded and will reach the fully folded position shown in FIG. 13 as the bale exits device 10.

While not shown in the present invention, it will be appreciated that conventional equipment, such as a strapping machine, may be used to secure the folded edges of bale 14. It will also be appreciated that the particular mounting devices for the various folder assemblies 30, 32, 34 and-36 can be variously embodied, and the pillar and shock dampening arrangements shown are preferred, but are not limiting. For example, while four shock dampers are shown for each of the assemblies 32, 34 and 36, more or less can be used, as long as some limited degree of rotational movement about the bearing supporting each assembly is provided. Furthermore, it may be desirable to have some degree of adjustability built into assemblies 32, 34 and 36, and such modification is shown in the FIGURES. Pillars 120, 122 and 124 each have a slot therein designated by numeral 180 (see for example FIG. 3). The pillars may be slidingly adjustable on a main frame element posts 182 with a locking member 184 acting therebetween. This pin and slot arrangement provides some degree of longitudinal movement toward and away from conveyor 22 so that the folds can be made as precisely as possible for the particular bale configuration. Other types of adjustment techniques would be readily appreciated by those skilled in the art after reading the present specification and are deemed to fall within the scope of the present invention. It can now also be appreciated that a device similar to assemblies 32, 34 and 36 can be used to form the side folds in the pulp wrapping process described earlier. Since only three flaps are folded in that operation, the positioning of a bale such that the vertical flap of the C-fold is located in the downstream position, and sliding of the bale past three vertical plates, such as those in 32, 34 and 36, will form the desired fold and eliminate another piece of moving equipment. Such use of the stationary folders of the invention for that purpose is within the scope of this invention.

The hoses for cylinder 87 and the various electrical components for drive motor 46 have not been shown but are, in and of themselves, conventional. Micro switches on the conveyor and simple input-output timing devices may be used, as can any number of alternatives which would be readily apparent to those skilled in the art. It should therefore be appreciated that the folder 10 according to its illustrated form is easy to install and to maintain and has only a few mechanical components which are subject to wear or failure. Unlike the folders of the prior art, only one component, i.e. the back tuck assembly 30, moves toward and away from bale 14, thereby reducing the number of potential mechanical problems by at least ¼ when compared to earlier designs. In addition, since folder assemblies 30, 32, 34 and 36 each possess only one degree of rotational freedom, construction is further simplified.

While the present invention has been described by reference to the thirteen FIGURES and certain illustrated components, one reading the specification will appreciate numerous alternatives and equivalents, all of which are deemed to fall within the scope hereof. The invention, therefore, is not to be limited by the drawings or the above description, but is to be limited solely by the scope of the claims which follow.

What is claimed is:

1. A machine for folding onto the end of an object having a generally rectangular cross section, an overwrap sheet material which covers at least three sides of said object and extends from at least one end of said object in such a manner that top and bottom generally horizontal flaps and two generally vertical side flaps remain to be folded onto said end, said machine comprising:

means for conveying said object along a path from an upstream first end to a downstream second end;

means for positioning said object so that said flaps are directed transversely of said conveyor means;

reciprocating rear flap folder means for moving toward and away from said conveyor means and folding onto said end of said object the upstream one of said side flaps;

means located downstream of said reciprocating means for folding onto said end of said object the remaining three flaps, said folding means comprising three substantially stationary vertical plate means arranged adjacent said conveyor means for engaging said three flaps as said object moves in a downstream direction to press said flaps inwardly onto said end, said vertical plate means being secured to the machine to permit limited movement of said vertical plate means with respect to said conveyor means.

2. The machine of claim 1 wherein said rear flap folder means comprises a rear flap folder plate support means for supporting rear flap folder plate and motor means for moving said rear flap folder plate toward and away from said conveyor means.

3. The machine of claim 2 wherein said support means consists of a horizontal plate means and said machine further comprises guide means for providing sliding reciprocation of said rear flap folder plate.

4. The machine of claim 3 wherein said motor means drives a shaft means, drive rod means coupling said shaft means and said horizontal plate means.

5. The machine of claim 2 wherein said support means includes a bearing member having a vertical axis, said rear flap folder means also including a cylinder means including outside rod means, said rear flap folder plate being coupled to said bearing member and to a extensible end of said rod means whereby said rear flap folder plate is rotatable about the said axis.

6. The machine of claim 1 wherein said vertical plate means are arranged to sequentially fold said downstream side flap, said bottom flap and said top flap.

7. The machine of claim 6 wherein each of said vertical plate means is mounted adjacent said conveyor means on bearing elements, each having a horizontal axis of rotation, and wherein damper means are provided for each of said vertical plate means for allowing limited movement of said vertical plate means about the axis of said bearing elements.

8. The machine of claim 7 wherein said machine further includes a frame for supporting said vertical plate means and pillar means for coupling said bearing elements to said frame.

9. The machine of claim 8 wherein said pillar means permits transverse adjustment of said vertical plate means toward and away from said conveyor means.

10. A machine for folding a sleeve of overwrap material onto an open end of a stack of pulp sheets comprising:

a conveyor for moving said stack along a path from a first upstream end to a second downstream end;

means upstream of said conveyor for positioning said stack so said open end is directed transversely of said conveyor path;

means for first folding the upstream vertical portion of said overwrap sleeve onto said open end including a vertical plate which reciprocates toward and away from said upstream vertical portion while said stack moves along said conveyor, said vertical plate being pivotal about a vertical axis from a first position in which the plane of said vertical plate intersects the plane of the open end of said stack at an angle to a second position in which the plane of said vertical plate is parallel to the plane of said open end; and means located downstream of said first folding means for folding sequentially the remaining portions of said overwrap sleeve inwardly onto said open end, said sequential folding means comprising three vertical plate means arranged adjacent said conveyor, each of which lies in a plane which is parallel to one another and to that of said open end.

11. The machine of claim 10 wherein said vertical plate means is arranged for engaging said remaining portions as said stack is moved in a downstream direction.

12. The machine of claim 11 wherein said remaining portions include a front flap, a bottom flap and a top flap and said plates are arranged to fold said flaps onto said open end in the sequence enumerated.

13. The machine of claim 12 wherein each of said vertical plate means is mounted adjacent said conveyor on a bearing element having a horizontal axis of rotation and wherein damper means are provided for each of said vertical plate means for allowing limited movement of said vertical plate means about the axis of said bearing elements.

14. The machine of claim 13 wherein said machine further includes a frame for supporting said vertical plate means and means for coupling said bearing elements to said frame.

15. The machine of claim 14 wherein said coupling means permits lateral adjustment of said vertical plate means toward and away from said conveyor.

16. A machine for folding a sleeve of overwrap material onto an open end of a stack of pulp sheets, said sleeve having first, second, third and fourth sides at said open end, said machine comprising:

a conveyor for moving said stack through the machine;

means for positioning said open end of said stack transversely to said conveyor;

a first vertical plate pivotal about a vertical axis from a first position in which the plane of said first vertical plate intersects the plane of said open end to a second position in which the plane of said first vertical plate is parallel to the plane of said open end, said first vertical plate reciprocal toward said first side for folding said first side inwardly onto said open end;

a second vertical plate arranged adjacent said conveyor, and in spaced relation to said first vertical plate, said second vertical plate free from interaction with said first vertical plate, said second vertical plate being substantially stationary with respect to said conveyor and lying in a plane parallel to said open end, said second vertical plate arranged for folding said second side inwardly onto said open end as said stack is moved through the machine;

a third vertical plate arranged adjacent said conveyor and proximate said second vertical plate, said third vertical plate substantially stationary with respect to said conveyor and lying in a plane parallel to said open end, said third vertical plate for folding said third side inwardly onto said open end as said stack is moved through the machine;

a fourth vertical plate arranged adjacent said conveyor and proximate said third vertical plate said fourth vertical plate being substantially stationary with respect to said conveyor and lying in a plane parallel to said open end, said fourth vertical plate for folding said fourth side inwardly onto said open end as said stack is moved through the machine.

17. The machine of claim 16 wherein said second, third and fourth vertical plates are arranged adjacent each other and in spaced relation from said first vertical plate for folding sequentially said second, third and fourth sides of said sleeve inwardly onto said open end as said stack is moved through the machine after said first side has been folded onto said open end.

* * * * *